US007814995B2

(12) United States Patent
Clausen et al.

(10) Patent No.: US 7,814,995 B2
(45) Date of Patent: Oct. 19, 2010

(54) HYDRAULIC JAR AND AN OVERPRESSURE RELIEF MECHANISM THEREFOR

(75) Inventors: Jeffery Ronald Clausen, Houston, TX (US); Jonathan Ryan Prill, Edmonton (CA); John Mitchel Cobb, Humble, TX (US)

(73) Assignee: National Oilwell Varco, L.P., Houston, TX (US)

( * ) Notice: Subject to any disclaimer, the term of this patent is extended or adjusted under 35 U.S.C. 154(b) by 100 days.

(21) Appl. No.: 12/051,140

(22) Filed: Mar. 19, 2008

(65) Prior Publication Data

US 2008/0236894 A1 Oct. 2, 2008

Related U.S. Application Data

(60) Provisional application No. 60/895,644, filed on Mar. 19, 2007.

(51) Int. Cl.
*E21B 4/14* (2006.01)

(52) U.S. Cl. ..... 175/297; 175/296

(58) Field of Classification Search ..... 175/57, 175/297, 296

See application file for complete search history.

(56) References Cited

U.S. PATENT DOCUMENTS 5,033,557 A * 7/1991 Askew ..... 175/297
5,086,853 A * 2/1992 Evans ..... 175/297
5,447,196 A 9/1995 Roberts
5,775,423 A * 7/1998 Kaczynski ..... 166/178
5,906,239 A * 5/1999 Oettli ..... 166/178
5,918,689 A * 7/1999 Roberts ..... 175/297
6,263,986 B1 7/2001 Massner et al.
6,453,997 B1 9/2002 McNeilly et al.
6,675,909 B1 1/2004 Cowart et al.
7,163,058 B2 1/2007 Bakke
7,347,287 B2 * 3/2008 Chancey ..... 175/297

* cited by examiner

*Primary Examiner*—Shane Bomar
(74) *Attorney, Agent, or Firm*—Conley Rose, P.C.

(57) ABSTRACT

A hydraulic jar for a drilling assembly is disclosed. In some embodiments, the hydraulic jar includes a tubular housing, a mandrel disposed in the housing, an annulus between the mandrel and the housing, and a pressure relief mechanism disposed in the annulus. The pressure relief mechanism generally divides the annulus into first and second portions. The pressure relief mechanism includes first and second annular members in engagement with one another when the pressure in the second annulus portion is less than a predetermined value and a fluid flow path between the first and second annulus portions. The fluid flow path has a first size when the pressure in the second annulus portion is less than the predetermined value, and a second size that is larger than the first size when the pressure in the second annulus portion becomes equal to or greater than the predetermined value.

22 Claims, 10 Drawing Sheets

HYDRAULIC JAR AND AN OVERPRESSURE RELIEF MECHANISM THEREFOR

CROSS-REFERENCE TO RELATED APPLICATIONS

This application claims benefit of U.S. provisional application Ser. No. 60/895,644 filed Mar. 19, 2007, and entitled "Hydraulic Jar Overpressure Relief Mechanism," which is hereby incorporated herein by reference in its entirety for all purposes.

STATEMENT REGARDING FEDERALLY SPONSORED RESEARCH OR DEVELOPMENT

Not applicable.

BACKGROUND

1. Field of Art

The disclosure relates generally to hydraulic jars for fishing and drilling applications, including those for recovery of oil and gas. More particularly, the disclosure relates to a mechanism disposed within a hydraulic jar to provide relief of fluid pressure within the hydraulic jar and prevent the application of excessive pressure to the hydraulic jar.

2. Background of Related Art

A hydraulic jar is a mechanical tool employed in downhole applications to dislodge drilling or production equipment that has become stuck within a wellbore. Typically the hydraulic jar is positioned in the drill string as part of the bottom hole assembly (BHA) and remains in place throughout the normal course of drilling the wellbore. FIG. 1 is a simplified schematic representation of a conventional hydraulic jar. The hydraulic jar 100 includes an inner mandrel 105 slidingly disposed within an outer housing 110 with a central flowbore 180 therethrough. During normal drilling operations, fluid, e.g., drilling mud, is delivered through central flowbore 180 to the drill bit (not shown). The upper end 115 of mandrel 105 is coupled to the drill pipe (not shown), while the lower end 135 of mandrel 105 is slidingly received within outer housing 110. The lower end 130 of outer housing 110 is coupled to the remaining components of the BHA (not shown). A sealed, annular chamber 150 containing hydraulic fluid is disposed between mandrel 105 and outer housing 110. A flow restrictor 155 is disposed within chamber 150 and coupled to mandrel 105, separating chamber 150 into an upper chamber 160 and a lower chamber 165. A hammer 120 is coupled to mandrel 105 between shoulders 125, 145 of outer housing 110.

When a portion of the drill string becomes stuck within the wellbore, either a tension or compression load is applied to the drill string, and the hydraulic jar 100 is then fired to deliver an impact blow intended to dislodge the stuck portion or component. For example, when a component becomes stuck below hydraulic jar 100, a tension load may be applied to the drill string, causing the drill string and mandrel 105 of hydraulic jar 100 to be lifted relative to outer housing 110 of hydraulic jar 100 and the remainder of the BHA, which remains fixed. As mandrel 105, with restrictor 155 coupled thereto, translates upward, fluid pressure in upper chamber 160 increases, and hydraulic fluid begins to slowly flow from upper chamber 160 through restrictor 155 to lower chamber 165. The increased fluid pressure of upper chamber 160 provides resistance to the applied tension load, causing the drill string to stretch and store energy, similar to a stretched rubberband. When a predetermined tension load is reached, hydraulic jar 100 is fired to deliver an impact blow. This is accomplished by releasing the tension load being applied to the drill string and allowing the stored energy of the stretched drill string to accelerate mandrel 105 rapidly upward within outer housing 110 until hammer 120 of mandrel 105 impacts shoulder 125 of outer housing 110. The momentum of this impact is transferred through outer housing 110 and other components of the BHA to dislodge the stuck component.

Alternatively, a compression load may be applied to the drill string, causing the drill string and mandrel 105 of hydraulic jar 100 to be translated downward within outer housing 110 of hydraulic jar 100 and the remainder of the BHA, which remains fixed. As mandrel 105, with restrictor 155 coupled thereto, translates downward, fluid pressure in lower chamber 165 increases, and hydraulic fluid begins to slowly flow from lower chamber 165 through restrictor 155 to upper chamber 160. The increased fluid pressure of lower chamber 165 provides resistance to the applied compression load, causing the drill string to compress and store energy, similar to a compressed spring. When a predetermined compression load is reached, hydraulic jar 100 is fired to deliver an impact blow. This is accomplished by releasing the compression load being applied to the drill string and allowing the stored energy of the stretched drill string to accelerate mandrel 105 rapidly downward within outer housing 110 until hammer 120 of mandrel 105 impacts shoulder 145 of outer housing 110. The momentum of this impact is transferred through outer housing 110 and other components of the BHA to dislodge the stuck component.

As described, hydraulic jars may be bi-directional, meaning they are capable of delivering an impact blow in both the uphole and downhole directions. Alternatively, a hydraulic jar may be uni-directional, meaning it is designed for and is capable of delivering an impact blow in either the uphole or downhole direction, but not both. Regardless, the common feature of each is that stored energy, created by stretching or compressing the drill string, is used to accelerate the mandrel of the hydraulic jar to deliver an impact blow to the outer housing. Moreover, the higher the load applied to the mandrel, the faster the acceleration of the mandrel and the greater the impact force delivered to the outer housing.

However, increased tension or compression load to the hydraulic jar may come at significant cost. Due to structural limitations of the hydraulic jar, excessive hydraulic fluid pressure may cause failure of seals within the hydraulic jar and/or the body of the hydraulic jar itself, i.e., the mandrel or the outer housing. Failure of the hydraulic jar results in loss of the tool itself, the inability to dislodge equipment stuck within the wellbore, and increased drilling time and expense. Given the costs associated with failure of a hydraulic jar, these tools are typically operated at only a fraction of their capacity. For example, the hydraulic jar may be fired when the tension or compression load applied reaches only three-fourths of the structural capacity of the hydraulic jar, rather than nearer the capacity of the tool. Due to frictional losses, the load delivered to the downhole end of the drill string will be less than the applied tension or compression load. Even so, the applied load is not typically increased to compensate for frictional losses because to do so increases the risk of jar failure. Hence, as a result of operating the hydraulic jar at a fraction of its capacity and frictional losses, the impact blow delivered by the hydraulic jar may be insufficient to dislodge stuck equipment or additional impact blows may be required, both increasing the time and cost associated for drilling the wellbore.

Accordingly, there remains a need for a hydraulic jar that may be operated near or at its structural capacity without causing damage to or failure of the hydraulic jar as may be caused by excessive hydraulic fluid pressure within the hydraulic jar.

BRIEF DESCRIPTION OF THE DRAWINGS

For a detailed description of the disclosed embodiments, reference will now be made to the accompanying drawings in which.

DETAILED DESCRIPTION OF THE DISCLOSED EMBODIMENTS

Figure 1:
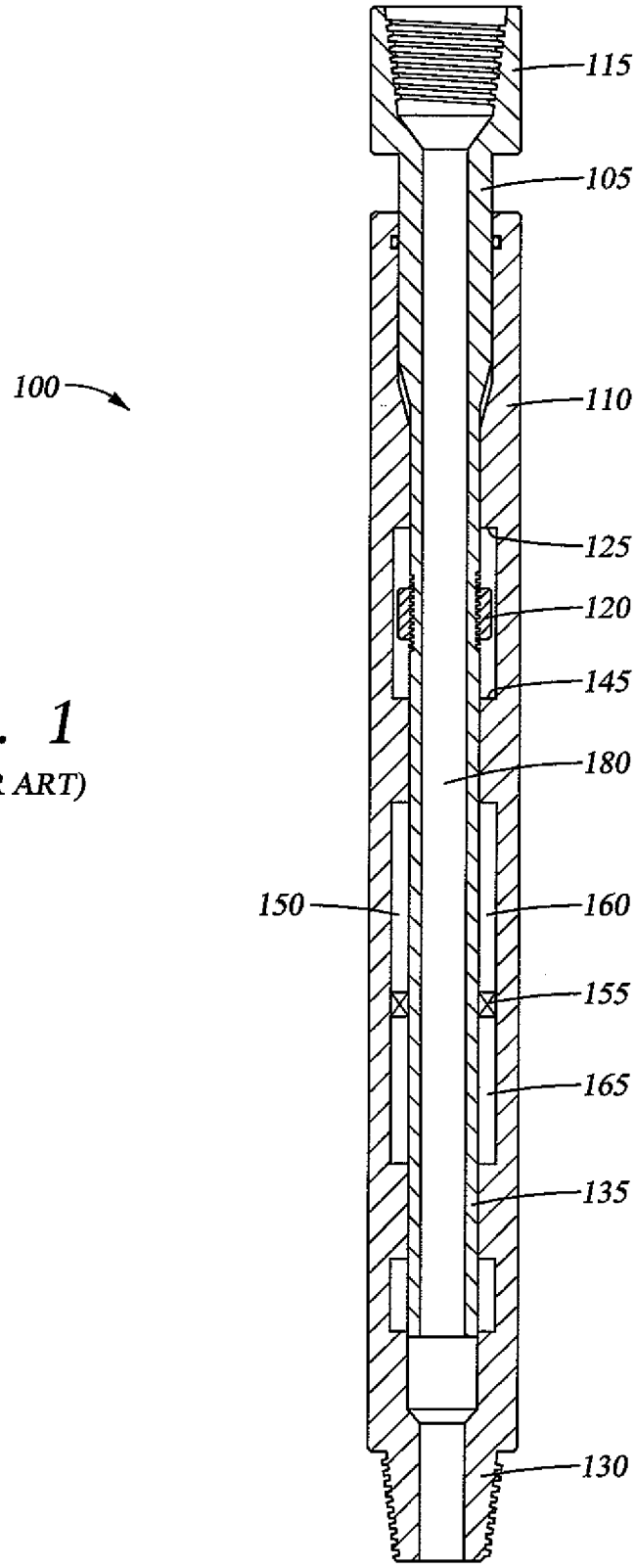
Fig. 1 (PRIOR ART)
FIG. 1 is a cross-sectional view of a conventional hydraulic jar.

The following discussion is directed to various exemplary embodiments of a hydraulic jar having a overpressure relief mechanism. One skilled in the art will understand that the following description has broad application, and the discussion of any embodiment is meant only to be exemplary of that embodiment, and not intended to suggest that the scope of the disclosure, including the claims, is limited to that embodiment. In particular, various embodiments of the overpressure relief mechanism are described in the context of a hydraulic jar. Even so, these components may be used in other downhole tools where a means for fluid pressure relief is needed or desired.

Certain terms are used throughout the description and claims that follow to refer to particular features or components. As one skilled in the art will appreciate, different persons may refer to the same feature or component by different names. This document does not intend to distinguish between components or features that differ in name but not function or structure. The drawing figures are not necessarily to scale. Certain features and components herein may be shown exaggerated in scale or in somewhat schematic form, and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices and connections. Further, the terms "axial" and "axially" generally mean along or parallel to a central or longitudinal axis, while the terms "radial" and "radially" generally mean perpendicular to a central longitudinal axis.

Figure 2:
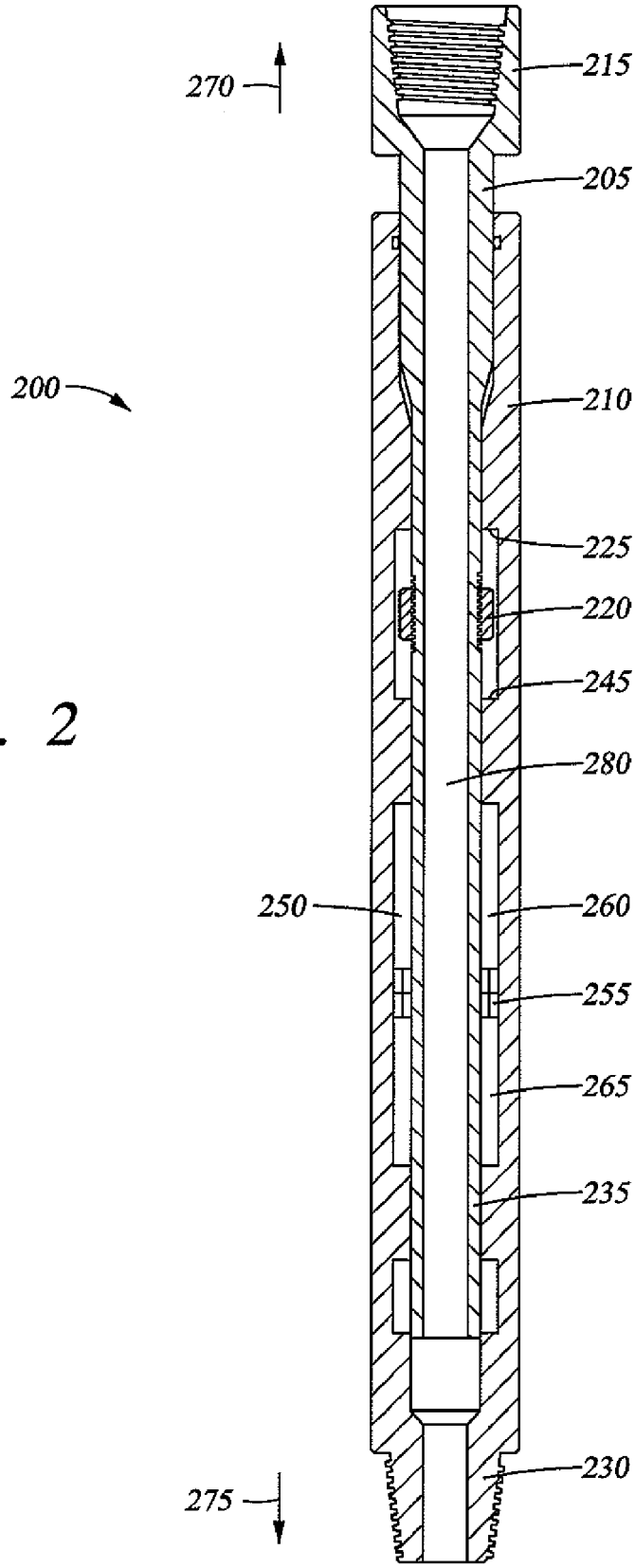
FIG. 2 is a cross-sectional view of a hydraulic jar having a bidirectional overpressure relief mechanism in accordance with the principles described herein.

Referring now to FIG. 2, a hydraulic jar 200 with an overpressure relief mechanism 255 is shown. Hydraulic jar 200 comprises a mandrel 205 slidingly disposed within an outer housing 210 with a central flowbore 280 therethrough. The upper end 215 of mandrel 205 is coupled to the drill pipe (not shown), while the lower end 235 of mandrel 205 is slidingly received within outer housing 210. The lower end 230 of outer housing 210 is coupled to the remaining components of the BHA (not shown). During normal drilling operations, fluid, e.g., drilling mud, is delivered through central flowbore 280 to the drilling bit (not shown). A sealed, annular chamber 250 containing hydraulic fluid is disposed between mandrel 205 and outer housing 210. Overpressure relief mechanism 255 is disposed within chamber 250 and coupled to mandrel 205, separating chamber 250 into an upper chamber 260 and a lower chamber 265. A hammer 220 is coupled to mandrel 205 between shoulders 225, 245 of outer housing 210.

Hydraulic jar 200 is bidirectional, meaning it may deliver an impact blow, as previously described, in either an uphole direction 270 or a downhole direction 275. Thus, when a tension load is applied to hydraulic jar 200, or more specifically, the uphole end 215 of mandrel 205, mandrel 205 translates in the uphole direction 270 relative to outer housing 210. Alternatively, when a compression load is applied to the uphole end 215 of mandrel 205, mandrel 205 translates in the downhole direction 275 relative to outer housing 210.

Overpressure relief mechanism 255 is configured to relieve hydraulic fluid pressure within chamber 250 when required to prevent component damage that might otherwise occur, as will be described. Overpressure relief mechanism 255 is also bidirectional, meaning it provides pressure relief whether hydraulic jar 200 is in tension or compression.

Figure 3:
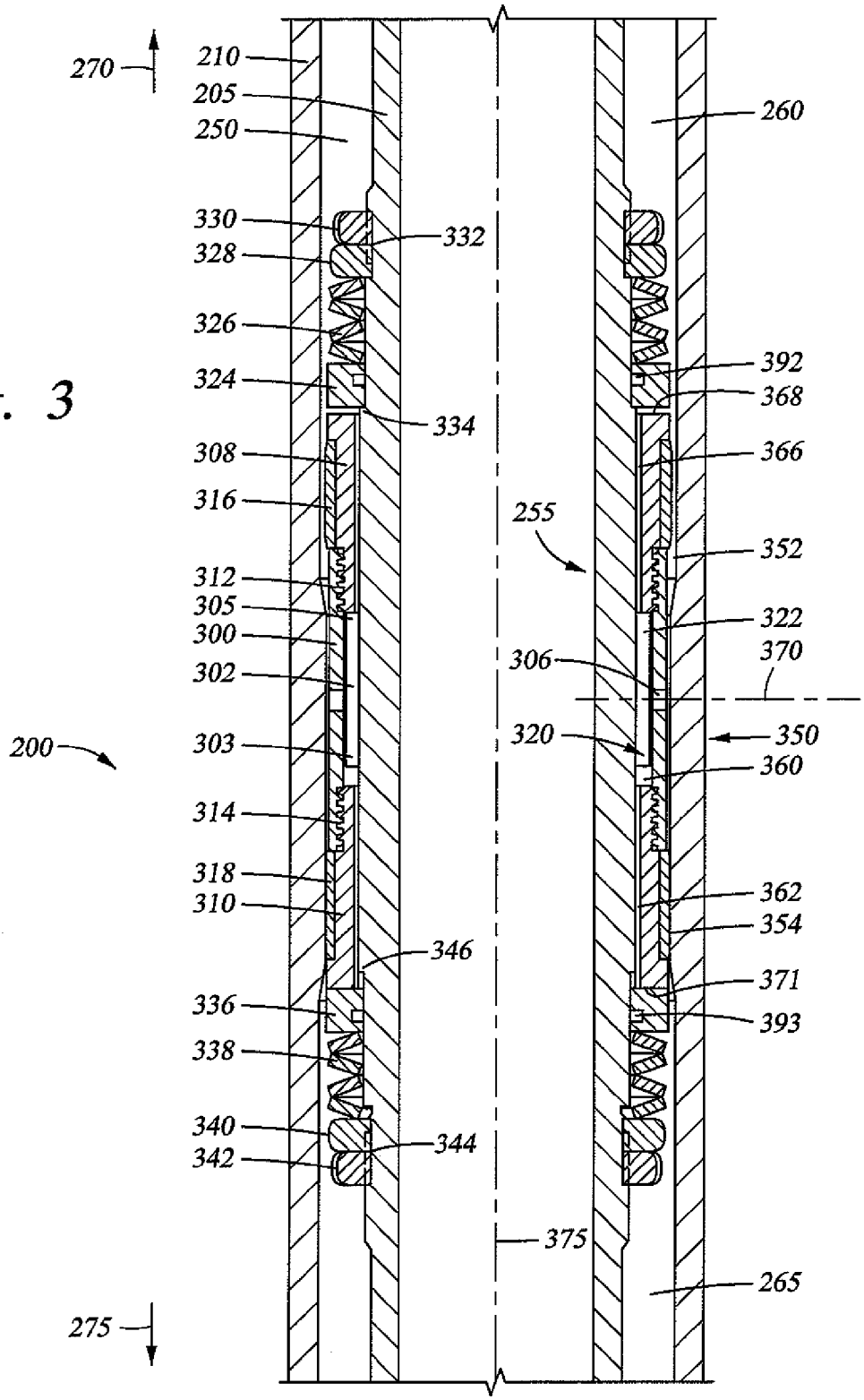
FIG. 3 is an enlarged, cross-sectional view of the hydraulic jar of FIG. 2 in tension.
Figure 4A:
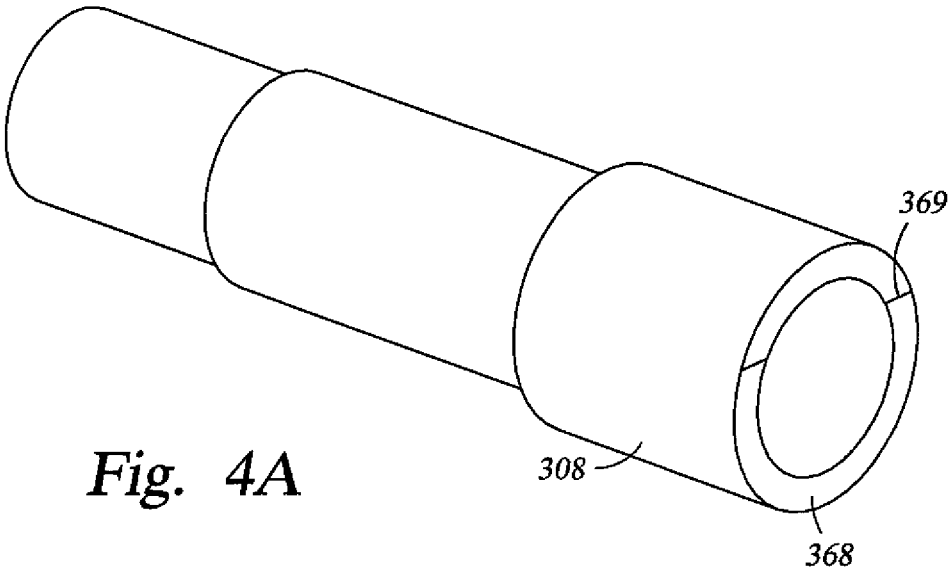
FIG. 4A is a perspective view of the upper sleeve of the overpressure relief mechanism of FIG. 3.

Turning now to FIG. 3, overpressure relief mechanism 255 comprises a seal ring retainer 300 disposed about a stop member 302. Stop member 302 is coupled to or integral with mandrel 205 and includes upper and lower ends forming shoulders 303, 305. Seal ring retainer 300 includes a port 306 extending radially therethrough and is coupled at each end between an annular or ring-shaped upper sleeve 308 and an annular or ring-shaped lower sleeve 310. Seal ring retainer 300 is positioned about mandrel 205 such that stop member 302 of mandrel 205 is between sleeves 308, 310. In this exemplary embodiment, seal ring retainer 300 and upper sleeve 308 are coupled via a threaded connection 312. Similarly, seal ring retainer 300 and lower sleeve 310 are coupled via a threaded connection 314. As shown in FIG. 4A, end face 368 of upper sleeve 308 includes a traverse groove 369 that allows fluid communication between upper chamber 260 and a small annulus 366 formed between upper sleeve 308 and outer surface 322 of mandrel 205. Similarly, end face 371 of lower sleeve 310 includes a traverse groove 372 that allows fluid communication between lower chamber 265 and a small annulus 362 formed between lower sleeve 310 and outer surface 322 of mandrel 205. Seal rings 316, 318 are compression fit around upper and lower sleeves 308, 310, respectively. In this manner, a reciprocating seal assembly 320 is formed by seal ring retainer 300 with upper sleeve 308, upper seal ring 316, lower sleeve 310 and lower seal ring 318 coupled thereto. Reciprocating seal assembly 320 is axially translatable over outer surface 322 of mandrel 205. Translational movement of reciprocating seal assembly 320 may be in either the uphole direction 270 or the downhole direction 275 direction, such translational movement being limited by engagement with shoulders 303, 305 of stop member 302.

To the uphole direction 270 of upper sleeve 308, overpressure relief mechanism 255 further comprises an annular or ring-shaped upper seal body 324, an upper spring 326, an upper retainer nut 328, and a backup retainer nut 330. Upper retainer nut 328 and backup retainer nut 330 are fixedly coupled to outer surface 322 of mandrel 205. In this exemplary embodiment, upper retainer nut 328 and backup retainer nut 330 are coupled to mandrel 205 by a threaded connection 332. Upper seal body 324 is translatable over outer surface 322 of mandrel 205 between upper retainer nut 328 and a shoulder 334 of mandrel 205. An o-ring seal 392 is disposed between upper seal body 324 and outer surface 322 of mandrel 205. Thus, when reciprocating seal assembly 320 translates axially in the uphole direction 270, upper sleeve 308 contacts upper seal body 324, causing upper seal body 324 to compress upper spring 326 against upper retainer nut 328. When reciprocating seal assembly 320 subsequently translates in the downhole direction 275, upper spring 326 expands, causing upper seal body 324 to translate until it engages or abuts shoulder 334.

To the downhole direction 275 of lower sleeve 310, overpressure relief mechanism 255 further comprises an annular or ring-shaped lower seal body 336, a lower spring 338, a lower retainer nut 340 and a backup retainer nut 342. Lower retainer nut 340 and backup retainer nut 342 are fixedly coupled to outer surface 322 of mandrel 205. In this exemplary embodiment, lower retainer nut 340 and backup retainer nut 342 are coupled to mandrel 205 by a threaded connection 344. Lower seal body 336 is translatable over outer surface 322 of mandrel 205 between lower retainer nut 340 and a shoulder 346 of mandrel 205. An o-ring seal 393 is disposed between lower seal body 336 and outer surface 322 of mandrel 205. Thus, when reciprocating seal assembly 320 translates axially in the downhole direction 275, lower sleeve 310 contacts lower seal body 336, causing lower seal body 336 to compress lower spring 338 against lower retainer nut 340. When reciprocating seal assembly 320 subsequently translates in the uphole direction 270, lower spring 338 expands, causing lower seal body 336 to translate until engaging or abutting shoulder 346.

Figure 5:
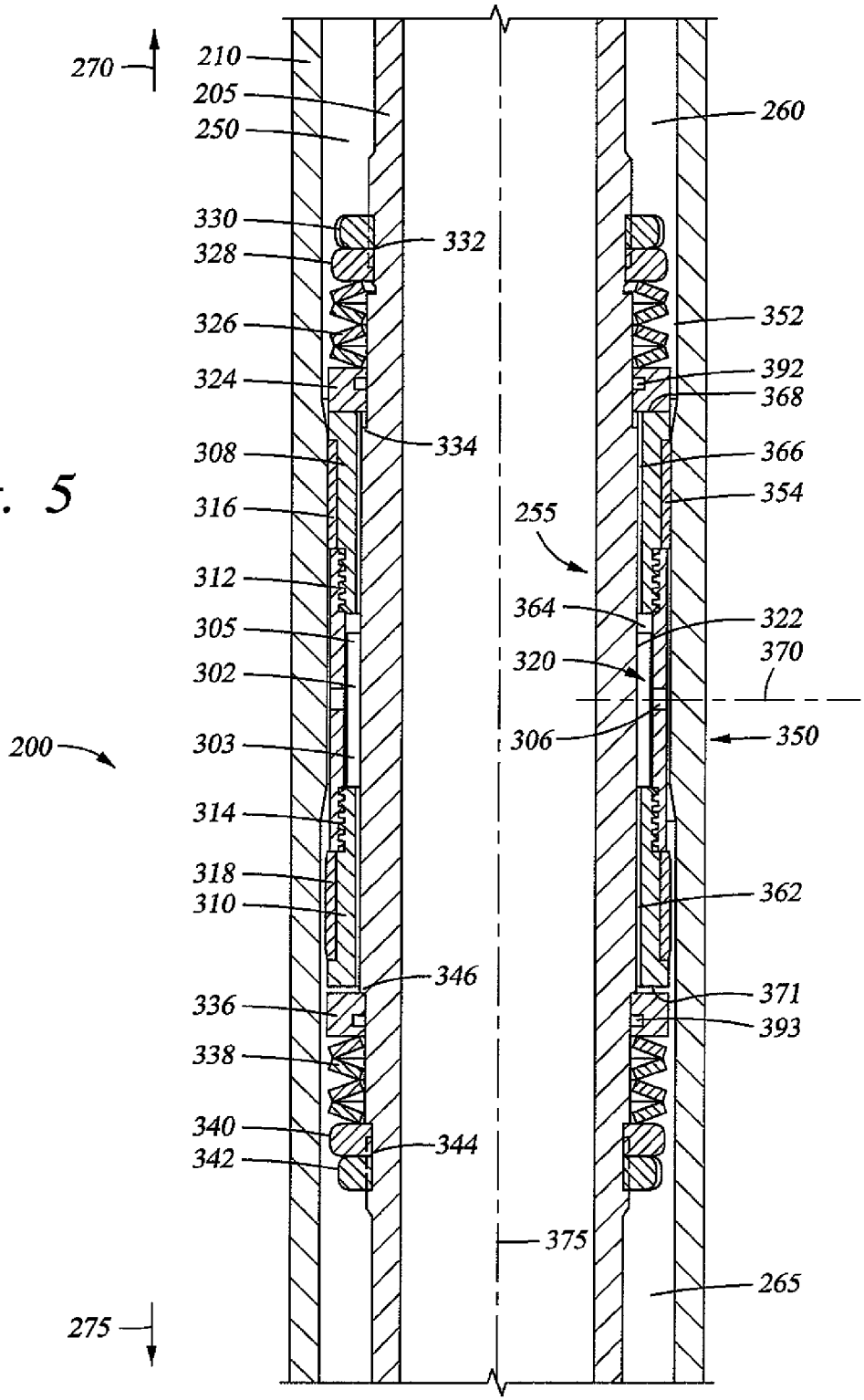
FIG. 5 is an enlarged, cross-sectional view of the hydraulic jar of FIG. 2 in compression.

Outer housing 210 comprises one or more reduced diameter portions or constrictions 350 along its inner surface 352 adjacent chamber 250. Depending on the axial position of overpressure relief mechanism 255 relative to a constriction 350, a seal is formed at region 354 between constriction 350 and lower seal ring 318, as shown in FIG. 3, and/or between constriction 350 and upper seal ring 316, as shown in FIG. 5. Thus, when aligned with a constriction 350, overpressure relief mechanism 255 sealing engages outer housing 210, dividing the annular chamber 250 into upper chamber 260 uphole of mechanism 255 and lower chamber 265 downhole of mechanism 255.

During normal drilling operations, overpressure relief mechanism 255 is positioned between constrictions 350 of outer housing 210 and not in sealing engagement with a constriction 350. When a component of the drill string becomes stuck and it is desired to deliver an impact blow to the drill string, a tension load may be applied to hydraulic jar 200, as previously described.

More specifically, a tension load may be applied to the uphole end 215 (FIG. 2) of mandrel 205. In response, mandrel 205 begins to translate axially within outer housing 210 in the uphole direction 270, bringing overpressure relief mechanism 255 into sealing engagement with a constriction 350 of outer housing 210. As a result of translation of mandrel 205 and alignment of overpressure relief mechanism 255 with constriction 350, fluid pressure in upper chamber 260 begins to increase. Also, translation of mandrel 205 causes reciprocating seal assembly 320 of overpressure relief mechanism 255 to similarly translate by virtue of contact with shoulder 305 of stop member 302, thereby engaging face 371 of lower sleeve 371 with the uphole face of lower seal body 336 and opening a chamber 360 between lower sleeve 310 and shoulder 303 of stop member 302. Hydraulic fluid then begins to flow from upper chamber 260 through overpressure relief mechanism 255. Specifically, hydraulic fluid flows from upper chamber 260 between inner surface 352 of outer housing 210 and reciprocating seal assembly 320 through port 306 in seal ring retainer 300 and into chamber 360 and coupled annulus 362. From annulus 362, hydraulic fluid flows through traverse groove 372 to lower chamber 265 at a flow rate limited by the small flow area of traverse groove 372. Thus, hydraulic fluid is metered from upper chamber 260 to lower chamber 265, allowing pressure buildup in upper chamber 260.

When a predetermined tension load that is believed sufficient or necessary to free the stuck tool is reached, hydraulic jar 200 is fired to deliver an impact blow, as previously described. However, in the event that the tension applied to hydraulic jar 200 exceeds a preselected or predetermined "safe" load before hydraulic jar 200 is fired, overpressure relief mechanism 255 actuates in the following manner to provide pressure relief to upper chamber 260 in order to prevent potential damage to or loss of hydraulic jar 200.

As mandrel 205 continues to translate in the uphole direction 270 under tension, fluid pressure in chamber 360 and annulus 362 continues to increase until the fluid pressure is sufficient to translate lower seal body 336 in the downhole direction 275 toward lower spring retainer nut 340 and compress lower spring 338. Thus, lower spring 338 serves and may be described as a pressure resistor. At the same time, reciprocating seal assembly 320 is constrained from downward translation by shoulder 305 of stop member 302. Thus, when lower seal body 336 begins to translate away from lower sleeve 310, the flow path between lower sleeve 310 and lower seal body 336 is opened significantly beyond that provided by traverse groove 372, allowing hydraulic fluid to pass from upper chamber 260 through chamber 360 and annulus 362 into lower chamber 265 at a substantially higher flow rate. As hydraulic fluid is bled off in this manner, hydraulic fluid pressure in upper chamber 260 decreases.

The spring stiffness of lower spring 338 is selected to allow compression of lower spring 338 when the hydraulic fluid pressure in upper chamber 260, and thus chamber 360 and annulus 362, reaches a predetermined magnitude. For example, lower spring 338 may be configured to compress under pressure at or near the structural limit, or pressure rating, of outer housing 210, mandrel 205 or some other component of hydraulic jar 200. In this way, overpressure relief mechanism 255 is configured to provide pressure relief when fluid pressure in upper chamber 260 nears the structural capacity of hydraulic jar 200 or a component thereof. By configuring overpressure relief mechanism 255 in this manner, hydraulic jar 200 may be operated near or at capacity. Before the fluid pressure in upper chamber 260 exceeds the pressure rating of hydraulic jar 200, overpressure relief mechanism 255 actuates to provide pressure relief and prevent damage to or failure of hydraulic jar 200.

Figure 4B:
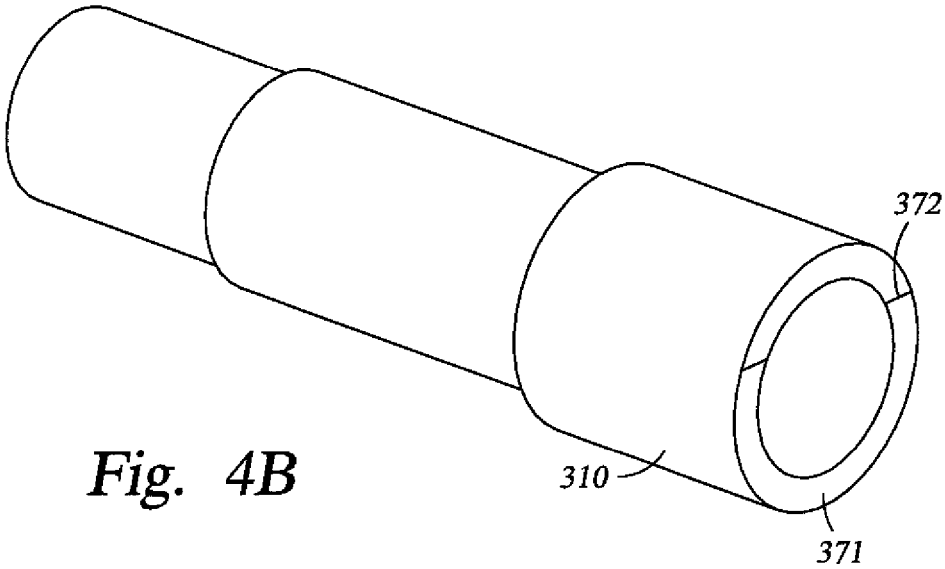
FIG. 4B is a perspective view of the lower sleeve of the overpressure relief mechanism of FIG. 3.

In a similar manner, when a component of the drill string becomes stuck and it is desired to deliver an impact blow to the drill string, a compression load may be applied to hydraulic jar 200, as previously described. More specifically, and referring to FIG. 4, a compression load may be applied to the uphole end 215 (FIG. 2) of mandrel 205. In response, mandrel 205 begins to translate axially downward within outer housing 210, bringing overpressure relief mechanism 255 into sealing engagement with a constriction 350 of outer housing 210.

As a result of translation of mandrel 205 and alignment of overpressure relief mechanism 255 with constriction 350, fluid pressure in lower chamber 265 begins to increase. Also, translation of mandrel 205 causes reciprocating seal assembly 320 of overpressure relief mechanism 255 to similarly translate by virtue of contact with shoulder 303 of stop member 302, thereby engaging face 368 of upper sleeve 308 with the downhole face of upper seal body 324 and opening a chamber 364 between upper sleeve 308 and shoulder 305 of stop member 302. Hydraulic fluid then begins to flow from lower chamber 265 into overpressure relief mechanism 255. Specifically, hydraulic fluid flows from lower chamber 265 between inner surface 352 of outer housing 210 and reciprocating seal assembly 320 through port 306 in seal ring retainer 300 and into chamber 364 and coupled annulus 366. From annulus 366, hydraulic fluid flows through traverse groove 369 to upper chamber 260 at a flow rate limited by the small flow area of traverse groove 369. Thus, hydraulic fluid is metered from lower chamber 265 to upper chamber 260, allowing pressure buildup in lower chamber 265.

When a predetermined compression load that is believed sufficient or necessary to free the stuck tool is reached, hydraulic jar 200 is fired to deliver an impact blow, as previously described. However, in the event that the compression load applied to hydraulic jar 200 exceeds a predetermined or preselected "safe" load before hydraulic jar 200 fires, overpressure relief mechanism 255 actuates in the following manner to provide pressure relief to lower chamber 265 in order to prevent potential damage to or loss of hydraulic jar 200.

As mandrel 205 continues to translate in the downhole direction 275 under compression, fluid pressure in chamber 364 and annulus 366 continues to increase until the fluid pressure is sufficient to translate upper seal body 324 in the uphole direction 270 toward upper spring retainer nut 328 and compress upper spring 326. Thus, upper spring 326 serves and may be described as a pressure resistor. At the same time, reciprocating seal assembly 320 is constrained from upward translation by shoulder 303 of stop member 302. Thus, when upper seal body 324 begins to translate away from upper sleeve 308, the flow path between upper sleeve 308 and upper seal body 324 is opened significantly beyond that provided by traverse groove 369, allowing hydraulic fluid to pass from lower chamber 265 through chamber 364 and annulus 366 into upper chamber 260 at a substantially higher flow rate. As hydraulic fluid is bled off in this manner, hydraulic fluid pressure in lower chamber 265 decreases.

The spring stiffness of upper spring 326 is selected to allow compression of upper spring 326 when the hydraulic fluid pressure in lower chamber 265, and thus chamber 364 and annulus 366, reaches a predetermined magnitude. For example, upper spring 326 may be configured to compress under pressure at or near the structural limit, or pressure rating, of outer housing 210, mandrel 205 or some other component of hydraulic jar 200. In this way, overpressure relief mechanism 255 is configured to provide pressure relief when fluid pressure in lower chamber 265 nears the structural capacity of hydraulic jar 200 or a component thereof. By configuring overpressure relief mechanism 255 in this manner, hydraulic jar 200 may be operated near or at capacity. Before the fluid pressure in lower chamber 265 exceeds the pressure rating of hydraulic jar 200, overpressure relief mechanism 255 actuates to provide pressure relief and prevent damage to or failure of hydraulic jar 200.

As described, overpressure relief mechanism 255 is bidirectional, meaning it provides pressure relief when hydraulic jar 200 is actuated via either tension or compression. It should be appreciated that the manner in which overpressure relief mechanism 255 provides pressure relief when hydraulic jar 200 is in tension is identical to the manner in which the overpressure relief mechanism 255 provides pressure relief when hydraulic jar 200 is in compression. Moreover, in this exemplary embodiment, the components of overpressure relief mechanism 255 downhole of seal ring retainer 300 are identical to those components of overpressure relief mechanism 255 uphole of seal ring retainer 300, except that downhole components are mirrored relative to the uphole components about a plane 370 bisecting seal ring retainer 300 and normal to a longitudinal centerline 375 through hydraulic jar 200. In other words, when viewing FIGS. 3 and 5, those components of overpressure relief mechanism 255 downhole of seal ring retainer 300 are mirror images of those components of overpressure relief mechanism 255 uphole of seal ring retainer 300.

It should also be appreciated that overpressure relief mechanism 255 may be constructed or reconfigured to be uni-directional, acting to provide pressure relief when hydraulic jar 200 is under either tension or compression, but not both. To reconfigure overpressure relief mechanism 255 to provide pressure relief only when hydraulic jar 200 is in tension, seal ring retainer 300 may be decoupled from upper sleeve 308. The components of overpressure relief mechanism 255 positioned uphole of seal ring retainer 300, including upper sleeve 308, may then be removed. A retaining nut, or similar component, may then be fixedly coupled to outer surface 322 of mandrel 205 proximate the uphole end of seal ring retainer 300 to limit translation of seal ring retainer 300 in the uphole direction 270.

Similarly, to reconfigure overpressure relief mechanism 255 to provide pressure relief only when hydraulic jar 200 is in compression, seal ring retainer 300 may be decoupled from lower sleeve 310. The components of overpressure relief mechanism 255 positioned downhole of seal ring retainer 300, including lower sleeve 310, may then be removed. A retaining nut, or similar component, may then be fixedly coupled to outer surface 322 of mandrel 205 proximate the downhole end of seal ring retainer 300 to limit translation of seal ring retainer 300 in the downhole direction 275.

The embodiments of an overpressure relief mechanism described below are bi-directional. However, for the sake of brevity, each embodiment is illustrated and described only with regard to how the embodiment provides pressure relief when hydraulic jar 200 is in tension. It should be understood, however, that each embodiment, like overpressure relief mechanism 255, also provides pressure relief when the hydraulic jar 200 is in compression in an identical fashion and using similar, but mirrored components from those illustrated and described. Moreover, each embodiment may be constructed or reconfigured to be unidirectional, as described above in regard to overpressure relief mechanism 255.

Figure 6:
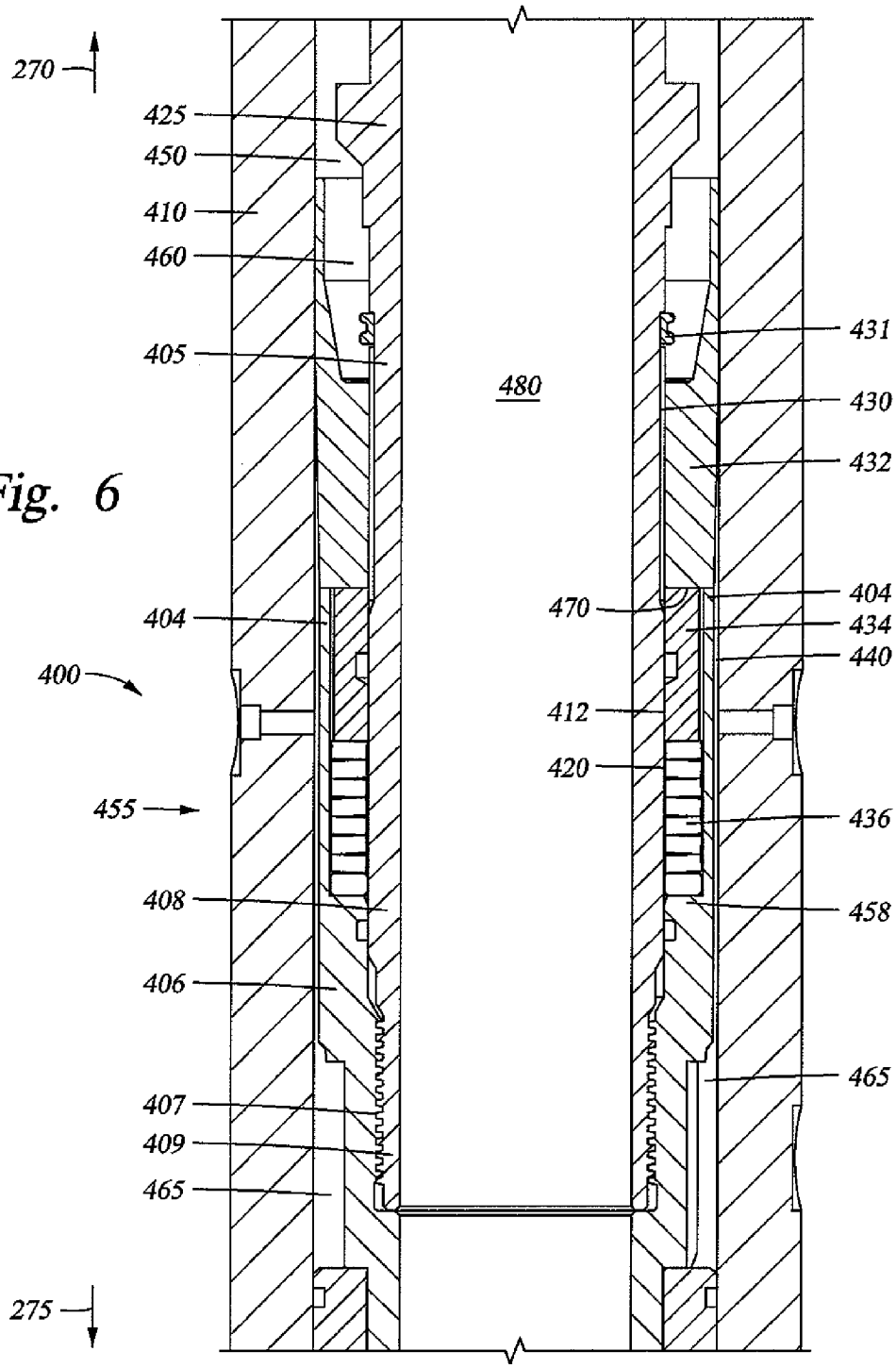
FIG. 6 is a cross-sectional view of another embodiment of a hydraulic jar having a bi-directional overpressure relief mechanism in accordance with the principles described herein.

Referring now to FIG. 6, a hydraulic jar 400 with an overpressure relief mechanism 455 is shown. Hydraulic jar 400 comprises a mandrel 405 slidingly disposed within an outer housing 410 with a central flowbore 480 therethrough. During normal drilling operations, drilling fluid is delivered through flowbore 480 to the drill bit (not shown). In this embodiment, mandrel 405 is a two-piece component comprising an upper mandrel portion 408 and a lower mandrel portion 406. Upper mandrel portion 408 comprises a lower end 409, while lower mandrel portion 406 comprises an upper end 404. Upper and lower mandrel portions 408, 406 are coupled near their respective ends 409, 404. In this exemplary embodiment, upper and lower mandrel portions 408, 406 are coupled by a threaded connection 407. The coupling of upper and lower mandrels portions 408, 406 forms a seal chamber 420 between end 404 of lower mandrel portion 406 and end 409 of upper mandrel portion 408.

Hydraulic jar 400 further comprises a sealed, annular hydraulic chamber 450 disposed between mandrel 405 and outer housing 410. Chamber 450 contains hydraulic fluid. Overpressure relief mechanism 455 is disposed within chamber 450 and coupled to mandrel 405, separating chamber 450 into an upper chamber 460 and a lower chamber 465.

Hydraulic jar 400 is bidirectional, meaning it may deliver an impact blow, as previously described, in either the uphole direction 270 or the downhole direction 275. Thus, when a tension load is applied to hydraulic jar 400, or more specifically, the uphole end 425 of mandrel 405, mandrel 405 translates in the uphole direction 270 relative to outer housing 410. Alternatively, when a compression load is applied to the uphole end 425 of mandrel 405, mandrel 405 translates in the downhole direction 275 relative to outer housing 410.

Figure 7:
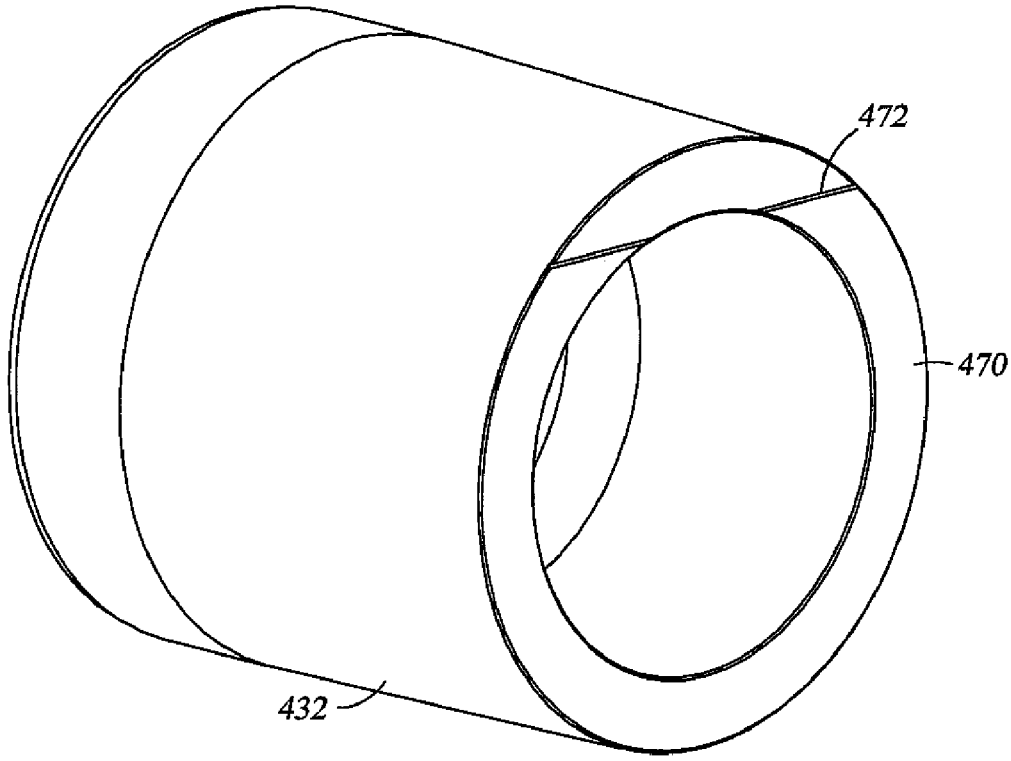
FIG. 7 is a perspective view of the cone of the overpressure relief mechanism of FIG. 6.

Overpressure relief mechanism 455 is configured to relieve hydraulic fluid pressure within chamber 450, as will be described. Overpressure relief mechanism 455 is also bidirectional, meaning it provides pressure relief whether hydraulic jar 400 is in tension or compression. Overpressure relief mechanism 455 comprises an annular or ring-shaped seal body 434 and a flexible member 436 both disposed within seal chamber 420. In this exemplary embodiment, flexible member 436 is a Belleville washer stack. However, in other embodiments, flexible member 436 may be a spring or other compressible/expandable device. In any event, flexible member 436 is compressible against a shoulder 458 of lower mandrel portion 406 under sufficient load from seal body 434. An annular or ring-shaped cone 432 is adjacent seal body 434. Cone 432 is inference fit with outer housing 410 and translatable over an outer surface 412 of mandrel 405 in the region between a cone retainer 431 and the upper end 404 of lower mandrel portion 406. As shown in FIG. 7, end face 470 of cone 432 includes a traverse groove 472. Referring again to FIG. 6, groove 472 allows fluid communication between annulus 430 and a small annulus 440 between outer housing 410 and the upper end 404 of lower mandrel portion 406. Seal body 434 is also translatable over outer surface 412 in the region between flexible member 436 and cone 432.

When a component of the drill string becomes stuck during drilling operations and it is desired to deliver an impact blow to the drill string, a tension load may be applied to hydraulic jar 400, as previously described. More specifically, a tension load may be applied to the uphole end 425 of mandrel 405. In response, mandrel 405 begins to translate axially upward within outer housing 410, and fluid pressure in upper chamber 460 begins to increase. Also, translation of mandrel 205 causes cone 432 to translate relative to mandrel 405 until face 470 of cone 432 engages to the uphole face of seal body 434. Due to the increase of fluid pressure in upper chamber 460, hydraulic fluid begins to flow from upper chamber 460 through a coupled annulus 430 formed between cone 432 and outer surface 412 of mandrel 405 to the interface between cone 432 and seal body 434. Hydraulic fluid in annulus 430 flows through groove 472 and similar traverse slots or grooves on end 404 of lower mandrel portion 406 to annulus 440 at a flow rate limited by the small flow area of traverse groove 472. From annulus 440, the hydraulic fluid flows into lower chamber 465. Thus, hydraulic fluid is metered from upper chamber 460 to lower chamber 465, allowing pressure buildup in upper chamber 460.

When a tension load believed sufficient or required to free the stuck tool is reached, hydraulic jar 400 is fired to deliver an impact blow, as previously described. However, in the event that the tension applied to hydraulic jar 400 exceeds a predetermined or preselected "safe" load before hydraulic jar 400 fires, overpressure relief mechanism 455 actuates in the following manner to provide pressure relief to upper chamber 460 in order to prevent potential damage to or loss of hydraulic jar 400.

As mandrel 405 continues to translate in the uphole direction 270, fluid pressure in upper chamber 460, and thus between cone 432 and seal body 434, continues to increase until the fluid pressure is sufficient to translate seal body 434 away from cone 432 and compress flexible member 436 against shoulder 458 of lower mandrel portion 406. Thus, flexible member 436 serves and may be described as a pressure resistor. When seal body 434 begins to translate away from cone 432, the flow path between cone 432 and seal body 434 is opened significantly beyond that provided by traverse groove 472, allowing hydraulic fluid to pass from upper chamber 460 through annulus 430 and annulus 440 into lower chamber 465 at a substantially higher flow rate. As hydraulic fluid is bled off in this manner, fluid pressure in upper chamber 460 decreases.

The stiffness of flexible member 436 is selected to allow compression of flexible member 436 when the fluid pressure in upper chamber 460 and acting on seal body 434 reaches a predetermined safe magnitude. For example, flexible member 436 may be configured to compress under fluid pressure at or near the structural limit or pressure rating of outer housing 410, mandrel 405, or some other component of hydraulic jar 400. In this way, overpressure relief mechanism 455 is configured to provide fluid pressure relief when fluid pressure in upper chamber 460 nears the structural capacity of hydraulic jar 400 or a component thereof. By configuring overpressure relief mechanism 455 in this manner, hydraulic jar 400 may be operated near or at capacity. Before the fluid pressure in upper chamber 460 exceeds the pressure rating of hydraulic jar 400, overpressure relief mechanism 455 actuates to provide pressure relief and prevent damage to or failure of hydraulic jar 400.

Figure 8:
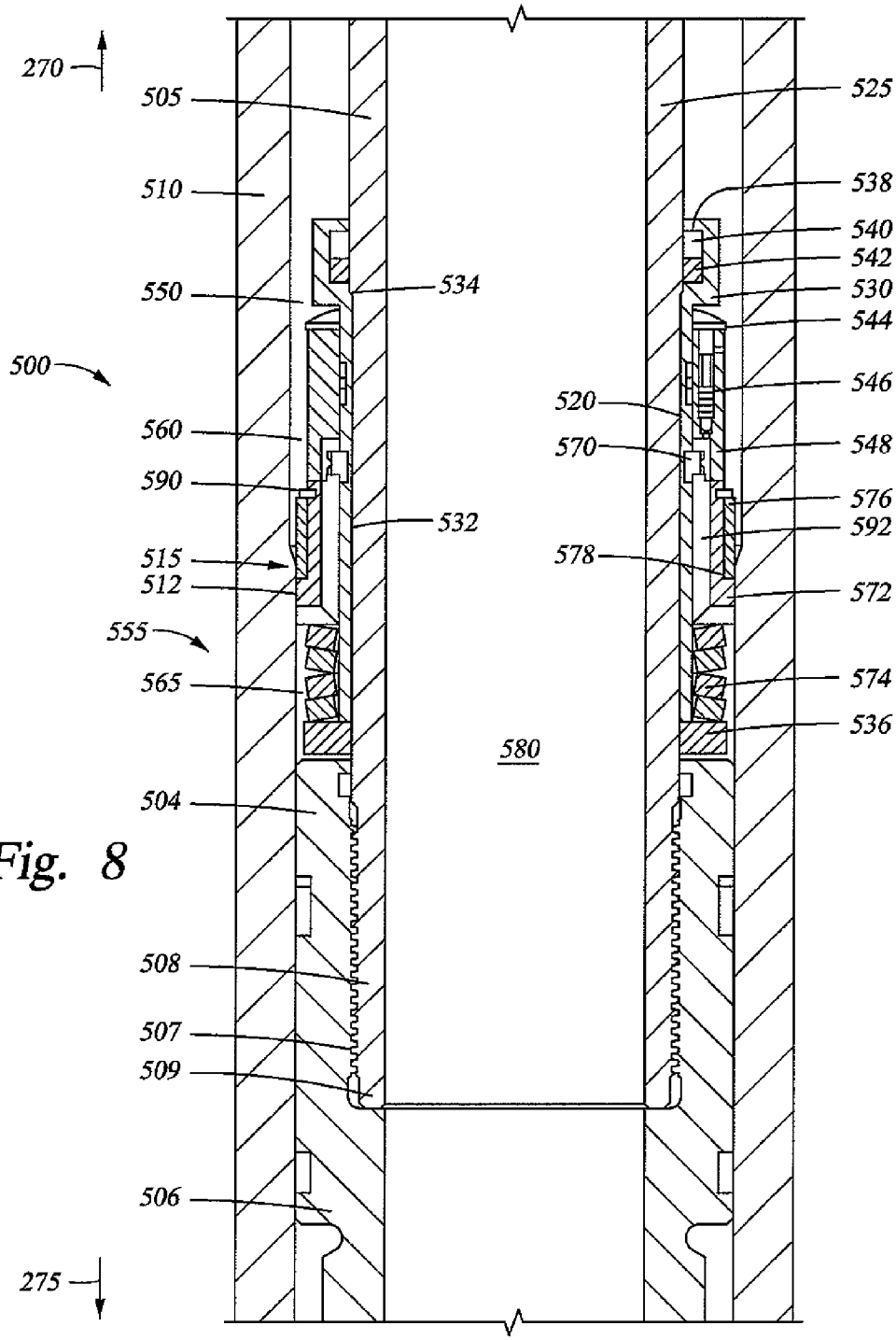
FIG. 8 is a cross-section view of yet another embodiment of a hydraulic jar having a bi-directional overpressure relief mechanism in accordance with the principles described herein.

Referring next to FIG. 8, a hydraulic jar 500 with an overpressure relief mechanism 555 is shown. Hydraulic jar 500 comprises a mandrel 505 slidingly disposed within an outer housing 510 with a central flowbore 580 therethrough. During drilling operations, fluid, e.g., drilling mud, is delivered through flowbore 580 to the drill bit (not shown). In this embodiment, mandrel 505 is a two-piece component comprising an upper mandrel portion 508 and a lower mandrel portion 506. Upper mandrel portion 508 comprises a lower end 509, while lower mandrel portion 506 comprises an upper end 504. Upper and lower mandrel portions 508, 506 are coupled near their respective ends 509, 504. In this exemplary embodiment, upper and lower mandrel portions 508, 506 are coupled by a threaded connection 507.

Hydraulic jar 500 further comprises a sealed, annular hydraulic chamber 550 disposed between mandrel 505 and outer housing 510. Chamber 550 contains hydraulic fluid. Overpressure relief mechanism 555 is disposed within chamber 550 and coupled to mandrel 505, separating chamber 550 into an upper chamber 560 and a lower chamber 565.

Hydraulic jar 500 is bidirectional, meaning it may deliver an impact blow, as previously described, in either the uphole direction 270 or the downhole direction 275. Thus, when a tension load is applied to hydraulic jar 500, or more specifically, the uphole end 525 of mandrel 505, mandrel 505 translates in the uphole direction 270 relative to outer housing 510. Alternatively, when a compression load is applied to the uphole end 525 of mandrel 505, mandrel 505 translates in the downhole direction 275 relative to outer housing 510.

Overpressure relief mechanism 555 is configured to relieve fluid pressure within chamber 550, as will be described. Overpressure relief mechanism 555 is also bidirectional, meaning it provides fluid pressure relief whether the hydraulic jar 500 is in tension or compression. Overpressure relief mechanism 555 comprises a seal sleeve 530 in sealing engagement with an outer surface 532 of mandrel 505. Seal sleeve 530 is disposed between a shoulder 534 formed on outer surface 532 and a spacer ring 536, which is fixedly coupled to outer surface 532. A seal chamber 538 is formed between seal sleeve 530 and outer surface 532 of mandrel 505. A first and a second sealing member 540, 542 are disposed within seal chamber 538.

Overpressure relief mechanism 555 further comprises a wave spring 544, an annular metering device body 548 with a metering device 546 disposed therein, a retaining ring 570, an annular seal body 572 and a spring 574 all seated on seal sleeve 530 between seal chamber 538 and spacer ring 536. Retaining ring 570 is fixedly coupled to seal sleeve 530 such that it does not translate relative seal sleeve 530. Seal body 572 is, however, translatable between retaining ring 570 and spring 574, which is compressible against spacer ring 536 under sufficient load from seal body 572. Metering device 546 extends axially through metering device body 548 and is capable of restricting fluid flow therethrough. In some embodiments, metering device 546 is an Axial Visco Jet metering device available through The Lee Company.

Like seal body 572, metering device body 548 is also translatable over seal sleeve 530. As shown, metering device body 548 is held in engagement with seal body 572 by wave spring 544. Thus, when seal body 572 translates in the downhole direction 275 compressing spring 574, wave spring 544 expands causing metering device body 548 to also translate and remain in contact with seal body 572 until metering device body 548 abuts retaining ring 570. After metering device body 548 abuts retaining ring 570, further translation of seal body 572 against spring 574 causes metering device body 548 and seal body 572 to separate. Conversely, when spring 574 subsequently expands, seal body 572 translates in the uphole direction 270, eventually contacting metering device body 548 and pushing metering device body 548 against wave spring 544. Seal body 572 may continue to translate in the uphole direction 270, pushing metering device body 548 against wave spring 544, until seal body 572 abuts retaining ring 570.

A seal ring 576 surrounds seal body 572 and is held in position abutting a shoulder 578 of seal body 572 by a retaining ring 590. Outer housing 510 comprises one or more reduced diameter portions or constrictions 515 along its inner surface 520. Depending on the axial position of overpressure relief mechanism 555 relative to a constriction 515, a seal 512 is formed between constriction 515 and seal ring 576. Thus, when aligned with a constriction 515, overpressure relief mechanism 555 sealing engages outer housing 510, dividing chamber 550 into an upper chamber 560 uphole of mechanism 555 and a lower chamber 565 downhole of mechanism 555.

During normal drilling operations, overpressure relief mechanism 555 is positioned between constrictions 515 of outer housing 510 and not in sealing engagement with a constriction 515. When a component of the drill string becomes stuck and it is desired to deliver an impact blow to the drill string, a tension load may be applied to hydraulic jar 500, as previously described. More specifically, a tension load is applied to the uphole end 525 of mandrel 505.

In response, mandrel 505 begins to translate axially upward within outer housing 510, bringing overpressure relief mechanism 555 into sealing engagement with a constriction 515 of outer housing 510. As a result of translation of mandrel 505 and alignment of overpressure relief mechanism 555 with constriction 515, fluid pressure in upper chamber 560 begins to increase. Also, hydraulic fluid begins to flow through overpressure relief mechanism 555 along a path from upper chamber 560 through metering device 546 and an annulus 592 in seal body 572 to lower chamber 565. The rate of fluid flow along this path is limited by metering device 546. As such, hydraulic fluid is metered from upper chamber 560 to lower chamber 565, allowing pressure buildup in upper chamber 560.

When a tension load believed sufficient to free the stuck tool is reached, hydraulic jar 500 is fired to deliver an impact blow, as previously described. However, in the event that the tension applied to hydraulic jar 500 exceeds a predetermined or preselected "safe" load before hydraulic jar 500 fires, overpressure relief mechanism 555 actuates in the following manner to provide pressure relief to upper chamber 560 in order to prevent potential damage to or loss of hydraulic jar 500.

As mandrel 505 continues to translate in the uphole direction 270, fluid pressure in upper chamber 560, metering device 546 and annulus 592 as well as acting on seal body 572 continues to increase until the fluid pressure is sufficient to translate seal body 572 away from metering device body 548 and compress spring 574 against spacer ring 536. Thus, spring 574 serves and may be described as a pressure resistor. As seal body 572 translates away from metering device 548, a flowpath between the two components opens, allowing a significantly increased rate of fluid flow from upper chamber 560 between metering device body 548 and seal body 572 through annulus 592 to lower chamber 565. As hydraulic fluid is bled off in this manner, fluid pressure in upper chamber 560 decreases.

The stiffness of spring 574 is selected to allow compression of spring 574 when the fluid pressure in upper chamber 560 and acting on seal body 572 reaches a predetermined magnitude. For example, spring 574 may be configured to compress under fluid pressure at or near the structural limit or pressure rating of outer housing 510, mandrel 505 or any other component of hydraulic jar 500. In this way, overpressure relief mechanism 555 is configured to provide pressure relief when fluid pressure in upper chamber 560 nears the structural capacity of hydraulic jar 500 or a component thereof. By configuring overpressure relief mechanism 555 in this manner, hydraulic jar 500 may be operated near or at capacity. Before fluid pressure in upper chamber 560 exceeds the pressure rating of hydraulic jar 500, overpressure relief mechanism 555 actuates to provide pressure relief and prevent damage to or failure of hydraulic jar 500.

Figure 9:
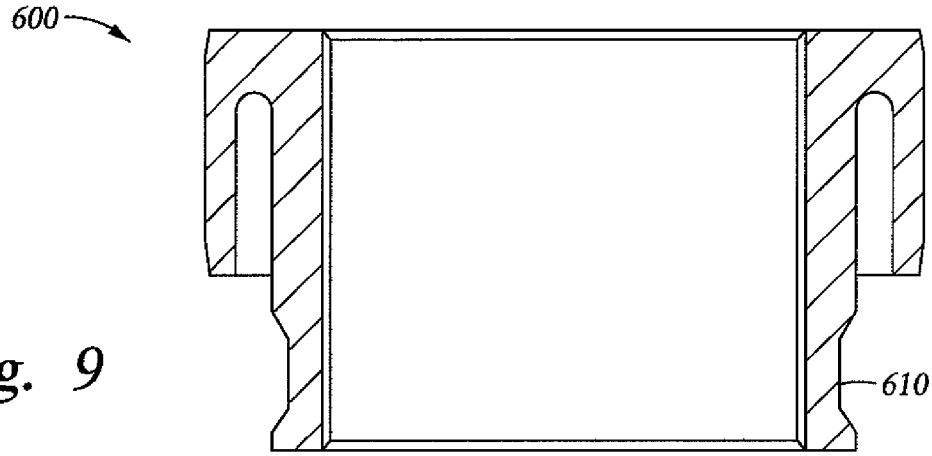
FIG. 9 is a cross-sectional view of flanged collar for use in modified embodiments of the overpressure relief mechanism of FIGS. 3 and 5.

FIG. 9 is a cross-sectional view of a flanged collar for use in modified embodiments of overpressure relief mechanism 255 of hydraulic jar 200, shown in and described with reference to FIGS. 3 and 5. As described previously, overpressure relief mechanism 255 comprises lower seal ring 318 compression fit around lower sleeve 310. Overpressure relief mechanism 255 may be modified by replacing lower sleeve 310 and lower seal ring 318 with the flanged collar 600 shown in FIG. 9. Similarly, upper sleeve 308 and upper seal ring 316 of overpressure relief mechanism 255 may also be replaced with another flanged collar 600. Each flanged collar 600 may be coupled at an end 610 to seal ring retainer 300 via threads, a set screw, or other equivalent fastening device. The resulting embodiment of hydraulic jar 200 with modified overpressure relief mechanism 255 disposed therein functions identically to the embodiment previously shown in and described with reference to FIGS. 3 and 5.

Figure 10:
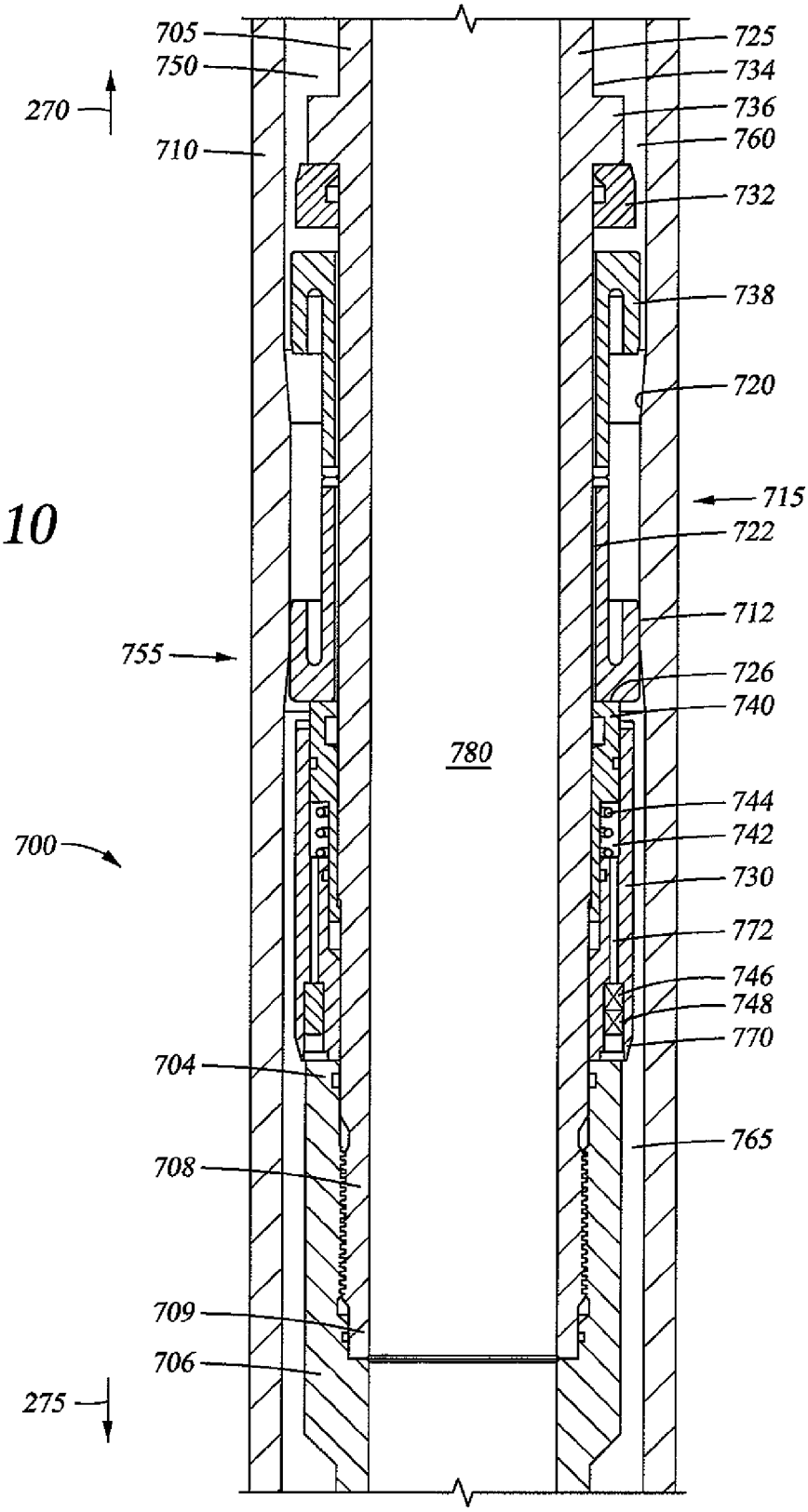
FIG. 10 is a cross-sectional view of another hydraulic jar having a hydraulically-actuated, bidirectional overpressure relief mechanism in accordance with the principles described herein.

The above-described embodiments of a hydraulic jar all comprise a mechanically actuated overpressure relief mechanism, meaning pressure relief occurs through actuation of a mechanical device, such as a spring, as shown in FIGS. 3, 5 and 8, or a Belleville washer stack, as shown in FIG. 6. In other embodiments, an overpressure relief mechanism may be hydraulically, rather than mechanically, actuated. FIG. 10 depicts one such embodiment.

Referring to FIG. 10, a hydraulic jar 700 with an overpressure relief mechanism 755 is shown. Hydraulic jar 700 comprises a mandrel 705 slidingly disposed within an outer housing 710 with a central flowbore 780 therethrough. During drilling operations, fluid, drilling fluid is delivered through flowbore 780 to the drill bit (not shown). In this embodiment, mandrel 705 is a two-piece component comprising an upper mandrel portion 708 and a lower mandrel portion 706. Upper mandrel portion 708 comprises a lower end 709, while lower mandrel portion 706 comprises an upper end 704. Upper and lower mandrel portions 708, 706 are coupled near their respective ends 709, 704. In this exemplary embodiment, upper and lower mandrel portions 708, 706 are coupled by a threaded connection 707.

Hydraulic jar 700 further comprises a sealed, annular hydraulic chamber 750 disposed between mandrel 705 and outer housing 710. Chamber 750 contains hydraulic fluid. Overpressure relief mechanism 755 is disposed within chamber 750 and coupled to mandrel 705, separating chamber 750 into an upper chamber 760 and a lower chamber 765.

Hydraulic jar 700 is bidirectional, meaning it may deliver an impact blow, as previously described, in either the uphole direction 270 or the downhole direction 275. Thus, when a tension load is applied to hydraulic jar 700, or more specifically, the uphole end 725 of mandrel 705, mandrel 705 translates in the uphole direction 270 relative to outer housing 710. Alternatively, when a compression load is applied to the uphole end 725 of mandrel 705, mandrel 705 translates in the downhole direction 275 relative to outer housing 710.

Figure 11:
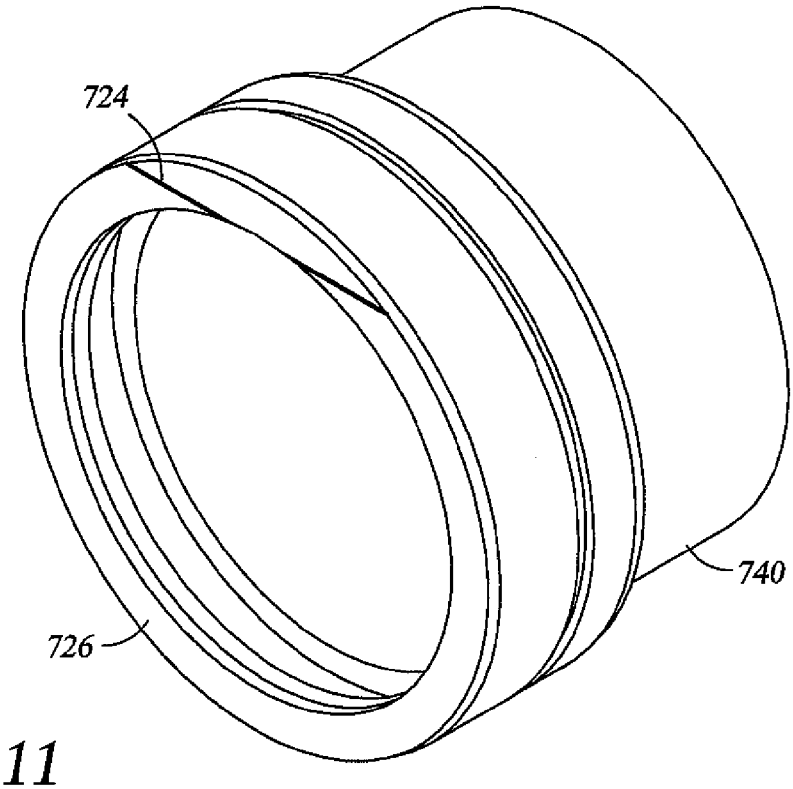
FIG. 11 is a perspective view of the seal body relief piston of the overpressure relief mechanism of FIG. 10.

Overpressure relief mechanism 755 is configured to relieve fluid pressure within chamber 750, as will be described. Overpressure relief mechanism 755 is also bidirectional, meaning it provides fluid pressure relief whether the hydraulic jar 700 is in tension or compression. Overpressure relief mechanism 755 comprises a hydraulic housing 730 and a seal body 732 fixedly coupled to an outer surface 734 of mandrel 705. Hydraulic housing 730 is proximate the upper end 704 of lower mandrel portion 706, while seal body 732 is proximate a shoulder 736 on upper mandrel portion 708. An annular cone 738 and an annular seal body relief piston 740 are disposed between seal body 732 and hydraulic housing 730. Cone 738 and seal body relief piston 740 are both translatable over surface 734 between seal body 732 and hydraulic housing 730. Referring now to FIG. 11, seal body relief piston 740 comprises a groove 724 in its uphole face 726 adjacent cone 738. Groove 724 allows fluid communication between lower chamber 765 and a small annulus 722 formed between cone 738 and outer surface 734 of mandrel 705.

Referring again to FIG. 10, hydraulic housing 730 and seal body relief piston 740 form a chamber 742 therebetween. A valve spring 744 is disposed in chamber 742. A check valve 746 and a pressure relief valve 748 are positioned within hydraulic housing 730 at its downhole end 770. A flow annulus 772 extends between chamber 742 of hydraulic housing 730 and valves 746, 748. Check valve 746 is configured to allow fluid to be drawn into chamber 742 as valve spring 744 expands against seal body relief piston 740, translating seal body relief piston 740 in the uphole direction 270. Pressure relief valve 748, on the other hand, is configured to exhaust fluid from chamber 742 to lower chamber 765 when the pressure of fluid contained within chamber 742 exceeds the crack pressure of relief valve 748.

Outer housing 710 comprises one or more reduced diameter portions or constrictions 715 along its inner surface 720. Depending on the axial position of overpressure relief mechanism 755 relative to a constriction 715, a seal 712 is formed between constriction 715 and cone 738. Thus, when aligned with a constriction 715, overpressure relief mechanism 755 sealing engages outer housing 710, dividing chamber 750 into an upper chamber 760 uphole of mechanism 755 and a lower chamber 765 downhole of mechanism 755.

During normal drilling operations, overpressure relief mechanism 755 is positioned between constrictions 715 of outer housing 710 and not in sealing engagement with a constriction 715. When a component of the drill string becomes stuck and it is desired to deliver an impact blow to the drill string, a tension load may be applied to hydraulic jar 700, as previously described. More specifically, a tension load is applied to the uphole end 725 of mandrel 705. In response, mandrel 705 begins to translate axially upward within outer housing 710, bringing overpressure relief mechanism 755 into sealing engagement with a constriction 715 of outer housing 710. Also, cone 738 translates axially downward until the downhole face of cone 738 engages face 726 of seal body relief piston 740.

As a result of translation of mandrel 705 and alignment of overpressure relief mechanism 755 with constriction 715, fluid pressure in upper chamber 760 begins to increase. Due to the increase in fluid pressure within upper chamber 760, fluid begins to flow through overpressure relief mechanism 755 along a path from upper chamber 760 through annulus 722 and groove 724 of seal body relief piston 740 to lower chamber 765. Thus, hydraulic fluid is metered from upper chamber 760 to lower chamber 765, allowing pressure buildup in upper chamber 760.

When a tension load believed sufficient or required to free the stuck tool is reached, hydraulic jar 700 is fired to deliver an impact blow, as previously described. However, in the event that the tension applied to hydraulic jar 700 exceeds a preselected "safe" load without hydraulic jar 700 firing, overpressure relief mechanism 755 actuates in the following manner to provide pressure relief to upper chamber 760 in order to prevent potential damage to or loss of hydraulic jar 700.

As mandrel 705 continues to translate in the uphole direction 270, fluid pressure in upper chamber 760 and acting on face 726 of seal body relief piston 740 continues to increase until the fluid pressure exceeds the pressure of fluid contained within chamber 742 of hydraulic housing 730, at which point cone 738 and seal body relief piston 740 begin to translate in the downhole direction 275. As cone 738 and seal body relief piston 740 translate in the downhole direction 275, chamber 742 grows smaller and the pressure of fluid contained therein increases. Translation of cone 738 and seal body relief piston 740 continues under pressure from fluid in upper chamber 760 until cone 738 abuts hydraulic housing 730 and is prevented from further movement downhole.

As fluid pressure in upper chamber 760 continues to increase, the fluid pressure acting on face 726 of seal body relief piston 740 also increases until the pressure of fluid contained within chamber 742 exceeds the crack pressure of pressure relief valve 748. Once the pressure of fluid contained within chamber 742, and thus the fluid pressure in upper chamber 760, exceeds the crack pressure of relief valve 748, fluid within chamber 742 of hydraulic housing 730 is vented through pressure relief valve 748. Seal body relief piston 740 is then allowed to translate in the downhole direction 275 away from cone 738. Thus, chamber 742 with hydraulic fluid contained therein serves and may be described as a pressure resistor. After cone 738 and seal body relief piston 740 separate, the flow rate of hydraulic fluid from upper chamber 760 through annulus 722 and behind cone 738 to lower chamber 765 substantially increases. As hydraulic fluid is bled off in this manner, fluid pressure in upper chamber 760 decreases.

Once the fluid pressure in upper chamber 760 decreases such that the pressure load exerted by valve spring 744 on seal body relief piston 740 exceeds the fluid pressure in upper chamber 760, valve spring 744 expands, causing seal body relief piston 740 to translate in the uphole direction 270. At the same time, chamber 742 expands and fluid is drawn in through check valve 746 to fill chamber 742. In this manner, seal body relief piston 740 is reset and chamber 742 is refilled for the next pull on hydraulic jar 700.

Pressure relief valve 748 is configured to exhaust fluid from chamber 742 of hydraulic housing 730 and allow seal body relief piston 740 to translate away from cone 738 when fluid pressure in chamber 742, and thus upper chamber 760, reaches a predetermined magnitude. For example, pressure relief valve 748 may be configured such that it has a crack pressure at or near the structural limit or pressure rating of outer housing 710, mandrel 705, or any other component of hydraulic jar 700. In this way, overpressure relief mechanism 755 is configured to provide fluid pressure relief when fluid pressure in upper chamber 760 nears the structural capacity of hydraulic jar 700 or a component thereof. By configuring overpressure relief mechanism 755 in this manner, hydraulic jar 700 may be operated near or at capacity. Before fluid pressure in upper chamber 760 exceeds the predefined "safe" pressure, a pressure slightly less than the pressure rating of hydraulic jar 700, for example, overpressure relief mechanism 755 actuates to provide pressure relief and prevent damage to or failure of hydraulic jar 700.

While various preferred embodiments have been showed and described, modifications thereof can be made by one skilled in the art without departing from the spirit and teachings herein. The embodiments herein are exemplary only, and are not limiting. Many variations and modifications of the apparatus disclosed herein are possible and within the scope of the invention. Accordingly, the scope of protection is not limited by the description set out above, but is only limited by the claims which follow, that scope including all equivalents of the subject matter of the claims

What is claimed is:

1. A hydraulic jar for a drilling assembly, comprising:

a tubular housing;

a mandrel disposed in the housing;

an annulus between the mandrel and the housing;

a pressure relief mechanism disposed in the annulus and generally dividing the annulus into first and second portions, the pressure relief mechanism comprising:

a first annular member having a first face;

a second annular member having a second face, wherein the second annular member is translatable relative to the first annular member between an engaged position in which the faces are engaged and a disengaged position in which the faces are spaced apart;

a groove in at least one of the first and second faces, the groove providing fluid communication between the first and second portions of the annulus; and a fluid flow path extending between the first and second portions of the annulus, the fluid flow path having a first size when the fluid pressure in the first portion of the annulus is less than a predetermined value, and having a second size that is larger than the first size when the fluid pressure in the first portion of the annulus is equal to or greater than the predetermined value.

2. The hydraulic jar of claim 1, wherein the annular members of the pressure relief mechanism are adapted to move longitudinally within the annulus.

3. The hydraulic jar of claim 1, wherein the pressure relief mechanism comprises a pressure resistor applying a biasing force against the second annular member in a direction toward the first annular member.

4. The hydraulic jar of claim 3, wherein the pressure resistor comprises a hydraulic chamber.

5. The hydraulic jar of claim 4, further comprising a relief valve having a crack pressure and disposed within said pressure resistor, said pressure resistor applying the biasing force when the fluid pressure in the first portion is less than the crack pressure of the relief valve.

6. The hydraulic jar of claim 3, wherein the pressure resistor comprises a member taken from the group consisting of a spring member and a Belleville washer.

7. The hydraulic jar of claim 3, wherein the mandrel includes an annular chamber, and wherein said pressure resistor and the second annular member are disposed in said chamber.

8. The hydraulic jar of claim 1, wherein the tubular housing further comprises at least one reduced diameter portion sealingly engaging at least one of the annular members.

9. The hydraulic jar of claim 1, wherein at least one of the annular members comprises a metering device, the metering device forming a portion of the fluid flow path.

10. The hydraulic jar of claim 1, wherein the second annular member is displaceable by fluid pressure from the engaged position to the disengaged position when the fluid pressure in the first portion reaches the predetermined value.

11. The hydraulic jar of claim 10, wherein a pressure resister displaces the second annular member from the disengaged position to the engaged position when the pressure in the first portion falls below the predetermined value.

12. The hydraulic jar of claim 1, wherein a portion of the fluid flow path is between the first and second annular members when the second annular member is in the engaged position and in the disengaged position.

13. A hydraulic jar for a drilling assembly, the hydraulic jar comprising:

a mandrel slidably disposed within an outer housing;

an annulus therebetween; and a pressure relief device disposed within the annulus, the pressure relief device dividing the annulus into a first region and a second region that is in fluid communication with the first region, the pressure relief device comprising:

a first annular member;

a second annular member translatable relative to the first annular member between an engaged position, wherein the second annular member abuts the first annular member, and a disengaged position, wherein the second annular member is displaced from the first annular member;

a fluid flow path between the first and second annular members, the fluid flow path having a first size when the second annular member is in the engaged position, and having a second size that is larger than the first size when the second annular member is in the disengaged position; and a pressure resistor biasing the second annular member toward the engaged position.

14. The hydraulic jar of claim 13, wherein the second annular member is slidably disposed on an outer surface of the mandrel between the pressure resistor and the first annular member, and wherein the second annular member is translatable against the pressure resistor from the engaged position to the disengaged position.

15. The hydraulic jar of claim 14, wherein the pressure resistor is one of a group consisting of a spring and a Belleville washer stack.

16. The hydraulic jar of claim 13, wherein the pressure resistor comprises a hydraulic chamber bounded on a side by the second annular member and wherein the pressure relief mechanism further comprises a pressure relief valve disposed within the hydraulic chamber and having a crack pressure;

wherein the pressure relief valve is configured to exhaust fluid from the hydraulic chamber when the pressure of fluid contained within the hydraulic chamber exceeds the crack pressure, wherein the second annular member translates to increase the size of the fluid flow path between the first annular member and the second annular member.

17. The hydraulic jar of claim 16, further comprising a check valve disposed within the hydraulic chamber, the check valve configured to allow fluid to pass therethrough into the hydraulic chamber.

18. The hydraulic jar of claim 13, wherein the second annular member is displaceable by fluid pressure from the engaged position to the disengaged position when the fluid pressure in the first region is greater than or equal to a predetermined value; and wherein the second annular member is displaceable by the pressure resistor from the disengaged position to the engaged position when the fluid pressure in the first region is less than the predetermined value.

19. The hydraulic jar of claim 18, wherein the predetermined value is substantially equal to a structural limit of the hydraulic jar.

20. A hydraulic jar for a drilling assembly, comprising:

a tubular housing;

a mandrel disposed in the housing;

an annulus between the mandrel and the housing;

a pressure relief mechanism disposed in the annulus and generally dividing the annulus into first and second portions, the pressure relief mechanism comprising:

a first annular member;

a second annular member translatable relative to the first annular member between an engaged position in which the first and second annular members are engaged and a disengaged position in which the first and second annular members are spaced apart;

a fluid flow path between the first and second annular members when the second annular member is in the engaged position and in the disengaged position, the fluid flow path having a first size when the second annular member is in the engaged position, and having a second size that is larger than the first size when the second annular member is in the disengaged position;

wherein the second annular member is displaceable by fluid pressure from the engaged position to the disengaged position when the fluid pressure in the first region is greater than or equal to a predetermined value; and wherein the second annular member is displaceable by a pressure resistor from the disengaged position to the engaged position when the fluid pressure in the first region is less than the predetermined value.

21. The hydraulic jar of claim 20, wherein the first annular member has a first face and the second annular member has a second face; and wherein at least one of the faces has a groove therein.

22. The hydraulic jar of claim 20, further comprising the pressure resistor biasing the second annular member toward the engaged position.

* * * * *